United States Patent [19]

Jeschke

[11] Patent Number: 4,591,143

[45] Date of Patent: May 27, 1986

[54] APPARATUS AND METHOD FOR IN-REGISTER FEEDING OF SHEETS

[75] Inventor: Willi Jeschke, Heidelberg, Fed. Rep. of Germany

[73] Assignee: Heidelberger Druckmaschinen AG, Heidelberg, Fed. Rep. of Germany

[21] Appl. No.: 593,647

[22] Filed: Mar. 26, 1984

[30] Foreign Application Priority Data

Mar. 26, 1983 [DE] Fed. Rep. of Germany ..... 3311197

[51] Int. Cl.[4] ..... B65H 9/10; B65H 9/06; B65H 9/20

[52] U.S. Cl. ..... 271/227; 271/236; 271/241; 271/250

[58] Field of Search ..... 271/238, 230, 231, 236, 271/245, 255, 241, 249, 252, 227, 228

[56] References Cited

U.S. PATENT DOCUMENTS 3,743,277 7/1973 Bolza-Schünemann et al. ... 271/250 X 4,060,237 11/1977 Degen et al. ..... 271/237 X 4,184,673 1/1980 Weisbach ..... 271/237

*Primary Examiner*—Bruce H. Stoner, Jr.

*Assistant Examiner*—Lawrence J. Goffney, Jr.

*Attorney, Agent, or Firm*—Herbert L. Lerner; Laurence A. Greenberg

[57] ABSTRACT

An apparatus for in-register feeding a sheet into a sheet-processing machine by conveying the sheet in a given feed direction over a feed table includes front lays engageably by a leading edge of the sheet for aligning the leading edge of the sheet, a pair of said pull-type lays located in the feed table respectively on mutually opposite operator and drive sides of the feed table at a slight spacing from the front lays, both the side lays being movable in the plane of the feed table transversely to the given feed direction of the sheet, a device for driving at least one of the side lays, a device for positioning the sheet having at least one sensor for controlling a displacement stroke of the driven side lay, an air control device connected to a vacuum generator and to both of the side lays for controlling suction air flow to the side lays, at least one of the side lays having a device for applying suction to the sheet until static friction is assured preparatory to aligning a respective lateral edge of the sheet, and a method for carrying out the operation.

7 Claims, 2 Drawing Figures

Figure 1:
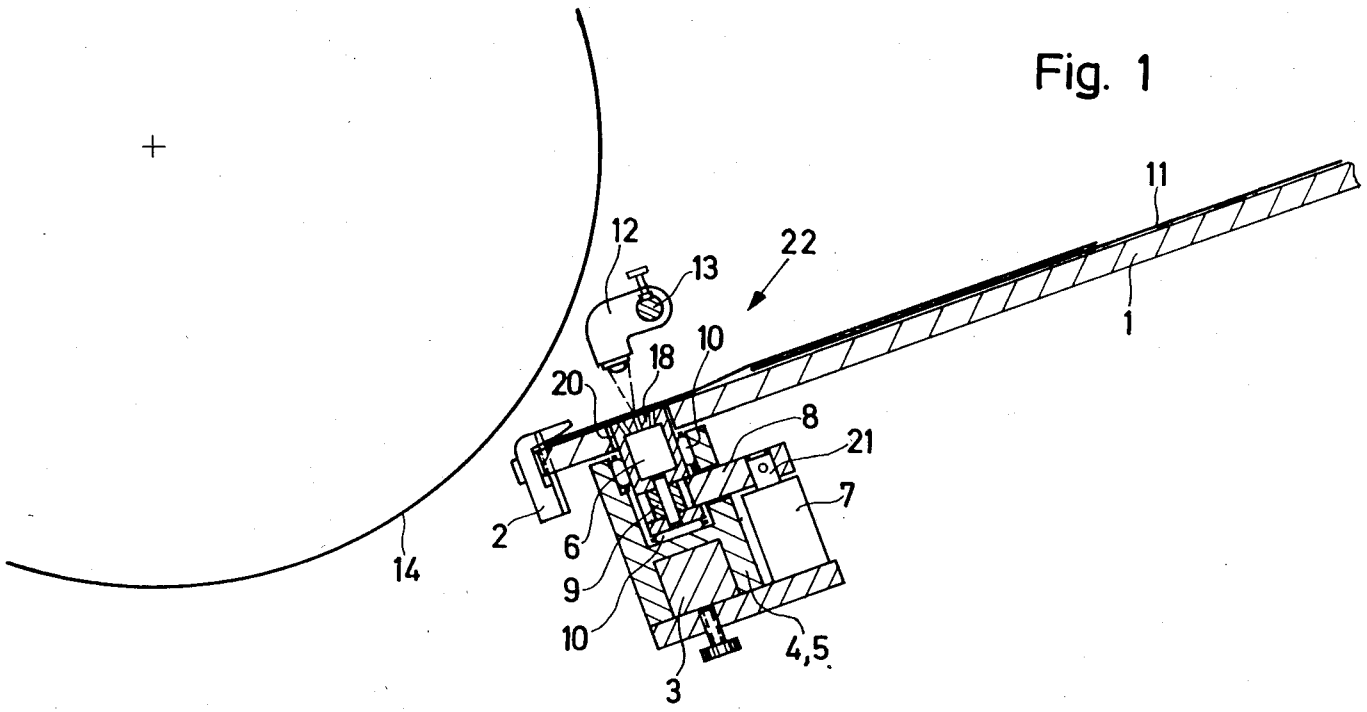

11
1
22
13
12
10
18
20
21
8
7
4,5
3
6
9
10
2
14

APPARATUS AND METHOD FOR IN-REGISTER FEEDING OF SHEETS

The invention relates to an apparatus and method for in-register feeding of sheets into a sheet-processing machine, the sheets being conveyed over a feed table and experiencing leading edge or sheet head alignment with the aid of front lays.

Register differences are often caused by a slight waviness on the paper. This waviness may occur during manufacture or storage of the paper or not until during the feed process. As is generally known, paper is a hygroscopic material which has the tendency to absorb moisture. Thus, the possibility exists for the paper to absorb or give off moisture when there is a change in the relative humidity of the atmosphere in the printing room, which results in dimensional variations and stresses, respectively, in the paper. Both of the latter may equally be the cause of register differences.

A sheet stretching device is known which is housed in the feed cylinder i.e. becomes effective before the first printing unit, and which can be adjusted while the printing press is in operation. It is part of the gripper bridge of the feed cylinder. It stretches the previously aligned sheet in a manner that, before it is transferred to the impression cylinder, the paper taken over with a greater or lesser extent of waviness is tautened. In this regard, prior to the stretching operation, the pretensioned gripper system is rendered partially force-free by lowering the gripper bar from the middle with the aid of an adjustable cam. The gripper bridge is divided in the middle so that by moving the gripper bridge halves apart the sheets are stretched. Thereafter, the gripper bars are again raised and the stretched sheet is fed to the impression cylinder.

This conventional sheet-stretching device requires a high additional mechanical outlay. Owing to the relatively large masses which have to be moved, the heretofore known device represents an obstacle to increasing the output of sheet-processing machines.

It is accordingly an object of the invention to provide an apparatus and method for in-register feeding of sheets which afford side alignment of the sheets without stops. Furthermore, it is an object of the invention to provide such an apparatus and method which will have an effect upon peripherally wavy or centrally wavy sheets prior to transfer thereof by the gripper systems of the feed cylinder. In this regard, it is an object of the invention to provide such an apparatus and method which, without using additional mechanical elements, applies a slight tension or compression to the sheet leading edge.

With the foregoing and other objects in view, there is provided, in accordance with the invention an apparatus for in-register feeding a sheet into a sheet-processing machine by conveying the sheet in a given feed direction over a feed table, comprising front lays engageable by a leading edge of the sheet for aligning the leading edge of the sheet, a pair of side pull-type lays located in the feed table respectively on mutually opposite operator and drive sides of the feed table at a slight spacing from the front lays, both the side lays being movable in the plane of the feed table transversely to the given feed direction of the sheet, means for driving at least one of the side lays, positioning means having at least one sensor for controlling a displacement stroke of the driven side lay, air control means connected to a vacuum generator and to both of said side lays for controlling suction air flow to the side lays, at least one of the side lays having means for applying suction to the sheet until static friction is assured preparatory to aligning a respective lateral edge of the sheet.

In accordance with another feature of the invention, both of the side pull-type lays are driven, and there are provided means for regulating the displacement stroke of at least one of the driven side lays.

In accordance with an additional feature of the invention, the regulating means is actuatable for regulating the displacement stroke of the respective side lay during operation of the sheet-processing machine.

In accordance with a further feature of the invention, both of the side pull-type lays are driven so as to cover identical displacement strokes.

In accordance with an added feature of the invention, both of the side pull-type lays are driven so as to cover different displacement strokes.

In accordance with an an additional feature of the invention, one of the side pull-type lays is disposed at a scanning side of the feed table closer to the sensor than the other side lay, the air control means being actuatable for supplying reduced suction force to the one side lay so that the sheet is slidable on a suction surface of the one side lay.

In accordance with still another feature of the invention, the other side pull-type lay is controllable by the positioning means for performing a greater displacement stroke than that of the one side lay, and air control means is actuatable for supplying reduced suction force to the other side lay so as to apply a sliding friction to the sheet.

In accordance with still a further feature of the invention, the one driven side pull-type lay is located at the side of the feed table other than a scanning side thereof, and the air control means is actuatable for supplying the one driven side lay with suction air assuring a relatively high static friction, and the other non-driven side lay with suction air assuring a relatively low static friction whereby the sheet is able to slide on a suction surface of the other non-driven side lay.

In accordance with still an additional feature of the invention, the at least one driven side pull-type lay together with the driving means are adjustable transversely to the given sheet feed direction to accommodate a paper format being processed.

In accordance with again a further mode of the invention, there is provided a method of in-register feeding a sheet into a sheet-processing machine by conveying the sheet over a feed table until the sheet reaches front lays at which the leading edge of the sheet is aligned, which comprises moving the sheet engaging the front lays into a desired lateral position and aligning the lateral edge of the sheet in that position without the aid of any stops, the leading corners of the sheet being gripped by two side aligning devices.

In accordance with a concomitant mode of the invention, there is provided a method which comprises driving the two side aligning devices along respective side aligning paths of different length.

The method according to the invention as well as the apparatus for performing the method permit the sheet leading edge to be influenced or acted upon during the side alignment i.e. prior to acceptance or take-over of the sheet by a gripper bridge. This is of particular significance in the production of multicolor prints. The apparatus according to the invention is suitable for the correction of broad and narrow prints, respectively, and indeed when making multicolor prints with single-and multicolor offset printing presses, respectively.

A further advantage of the invention is that, irrespective of the paper size or format, the corrective force is always applied to the sheet at the corners by the side pull-type lays which are necessary anyway for side registration and which are adjustable to the side regions of the sheet. This is not performed at "high speed", which means the normal speed of the press, but is performed during the feed process. Aftcr the feed operation, it is no longer necessary to loosen individual grippers during the subsequent transport of the sheets for the purpose of stretching the leading edge of the sheet.

A special advantage derived from both side pull-type lays being driven and the displacement stroke of at least one of the side pull-type lays being regulatable is that the stretching or compression of the sheet leading edge during the side registration can be adjusted with extreme accuracy. Depending upon requirements, it is possible to provide a suction air control of both side pull-type lays whereby the sheet is sucked by one side pull-type lay to ensure static friction, while the other side pull-type lay exerts reduced suction force so that it is possible for the sheet to slide on the suction surface of the other side pull-type lay.

Other features which are considered as characteristic for the invention are set forth in the appended claims.

Although the invention is illustrated and described herein as embodied in an apparatus and method for in-register feeding of sheets, it is nevertheless not intended to be limited to the details shown, since various modifications and structural changes may be made therein without departing from the spirit of the invention and within the scope and range of equivalents of the claims.

Figure 2:
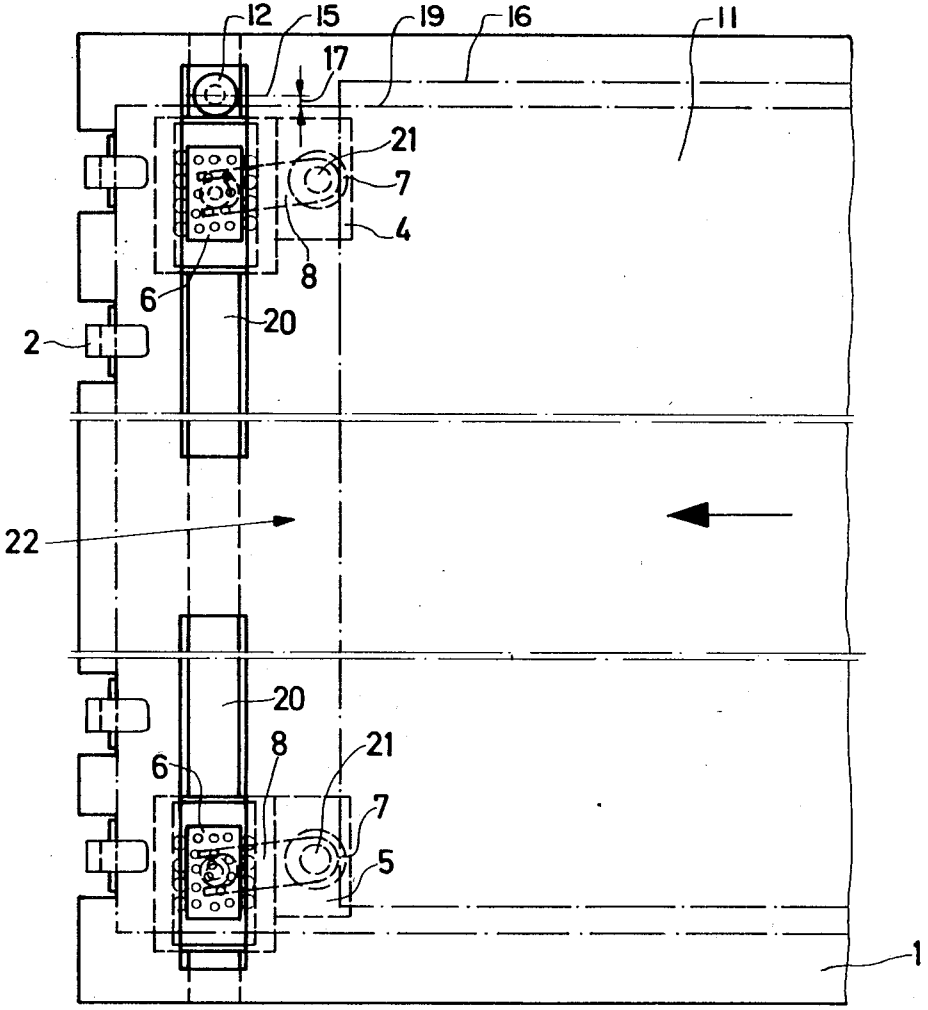

The construction and method of operation of the invention, however, together with additional objects and advantages thereof will be best understood from the following description of specific embodiments when read in connection with the accompanying drawings, in which:

FIG. 1 is a vertical sectional view of a feed table with a side aligning device according to the invention; and FIG. 2 is a fragmentary top plan view of FIG. 1 showing the feed table and parts of respective side aligning devices.

Referring now to the figures of the drawing, there is provided under the feed table 1 in a region directly before downwardly swingable front lays 2, a cross-member or traverse 3 which is mounted in non-illustrated side walls of the sheet feeder. On this cross member 3, two side-stretching or drawing devices 4 and 5 are disposed which are adjustable transversely to the sheet. The side-stretching device 4 is provided on the drive side, and the other side-stretching device 5 is provided on the operator side of the sheet feeder. Each side-stretching device 4 and 5, respectively, has a side pull-type or stretching lay 6 having a suction plane or surface 18 projecting through a gap 20 formed in the feed table 1 and lying in the plane of the surface of the feed table 1. Both side pull-type lays 6 of the side-stretching devices 4 and 5 can be displaced within a given range transversely to the sheet conveying direction in this gap 20. Adjustment of the working position of the side stretching devices 4 and 5 to the respective size or format of the sheet being processed is thus assured.

The side pull-type lays 6 are connected to a vacuum generator by means of a non-illustrated conventional air control device. The side pull-type lays 6 are driven by a stepping motor 7 which is coupled with zero-play i.e. free of play, to the appropriate side pull-type lay 6 by means of a fork 8 and a drive roller 9 rotatably mounted on the underside of the side pull-type lay 6. As for the rest, the fork 8 is fastened onto the shaft stub 21 of the stepping motor 7. Within the side-stretching devices 4 and 5, respectively, the corresponding side pull-type lay 6 is held respectively in several flat-cage bearings 10 so that it can move easily yet be precisely guided. Above the feed table 1, at the level of the side pull-type lays 6, a sensor 12 of an otherwise non-illustrated positioning device is mounted at the drive side on a cross-member or traverse 13 so as to be adjustable to the respective paper format. The sensor 12 may also be provided at the operator side if the aligning movement is to take place from the operator side to the drive side. The sheet feeder according to the invention can, therefore, be convertible for drive-side or operator-side feeding.

Non-registered sheets are conveyed in a continuous overlapping stream over the feed table 1 into the aligning region 22 of the feed table 1. After the sheet has been aligned, a feed cylinder 14 accepts the sheet which is in the desired position.

When the foremost sheet 11 in the stream comes up against the front lays 2, the leading edge is aligned initially owing to the propulsion or forward thrust, respectively, of the stream and of the transport elements of the feed table 1. Then the air control causes the sheet aligned at the leading edge thereof to be sucked up in the region of the side-pull type lays 6. The suction force is such that static friction is produced at the suction surfaces 18 of both side pull-type lays 6. The stepping motors 7 then begin to operate. They are controlled by the positioning device in a manner that they jointly move the sheet laterally i.e. in this case from the drive side to the operator side. While doing this, the drive-side edge 16 of the sheet 11 passes beyond the measuring line 15 of the sensor 12. The sensor 12 generates a pulse which causes the positioning device to continue the side transport of the sheet 11 by the stepping motors 7 until the sheet 11 has reached the desired or nominal lateral position 19 thereof. After the generation of the pulse by the sensor 12, the edge 16 and thus the entire sheet 11 have covered the constant distance 17. In this desired position, the sheet 11 is aligned in register with respect to the leading and side edges thereof. It is thus completely irrelevant in what side position the sheet 11 came up against the front lays 2 within a tolerance range, because after the generation of the pulse due to the sheet leading edge 16 passing beyond the measuring line 15 of the sensor 12, only the distance 17 is covered by the sheet 11.

By means of a control device coupled with the positioning device, it is possible to vary at will the displacement stroke of one of the stepping motors 11 or of both stepping motors 11 selectively. In the illustrated embodiment, the positioning device controls the drive-side stepping motor 7 so that it executes precisely the required displacement stroke whereby the edge 16 of the sheet which is up against the front lays 2 comes exactly into the position 19. Owing to the setting or adjustment of the control device, however, the stepping motor 7 at the operator side of the sheet feeder is positioned so that the displacement stroke is slightly greater than for the other side pull-type lay 6. This results in a stretching of a sheet leading edge, thereby counteracting waviness in the sheet leading edge. Should it be necessary to apply compressive force to the sheet leading edge, it is possible, with appropriate control of the positioning device, for the side pull-type lay 6 at the operator side to perform a shorter displacement stroke than for the side pull-type lay 6 at the drive side. In any case, it is important that, after the pulse has been generated by the sensor 12, the side pull-type lay 6 guiding the sheet moves the sheet edge 16 precisely into the desired or nominal position 19.

After the side alignment, and respective stretching and compressing of the sheet leading edge, the registered sheet 11 is transferred to the gripper systems of the feed cylinder 14.

The control of the displacement stroke of the side pull-type lays 6 can take place while the machine is in operation. This affords an extremely fine regulation and makes it possible to compensate for respectively broad and narrow prints. However, it is also possible to react extremely quickly to a change in the waviness of the sheets without stopping the press.

Of course, the displacement stroke can also be regulated so that both driven side pull-type lays 6 cover identical displacement strokes. In this case, the device according to the invention merely causes a side alignment of the sheet which is disposed against the front lays 2, without the aid of stops. There is no stretching or compressing of the sheet leading edge, because this is superfluous. If both displacement strokes are lengthened or shortened, it is possible to perform fine register regulation.

Should it merely be desired that the sheet lie flatter, or more planar, however, control is such that one pull-type lay executes a clearly different stroke from that of the other lay. In this connection, that side pull-type lay 6 which is nearest the sensor 12 can be supplied with reduced suction power so that, at the suction surface 18 thereof, the sheet is held only with sliding friction. Preferably, this lower-suction side pull-type lay 6 is not moved. It can also only cover a smaller displacement stroke, however. It is also possible for that side pull-type lay which is not on the scanning side of the feed table 1 to perform a larger displacement stroke and for it to be supplied with a reduced suction power producing sliding friction. In this case, the side pull-type lay 6 on the scanning side holds the sheet by means of static friction and, because it is controlled by the positioning device so that the edge 16 of the sheet 11 comes into position 19, the other side pull-type lay 6 with the greater displacement stroke and the reduced suction power causes a tautening of the sheet leading edge and a flattening of the sheet, respectively.

In another embodiment of the invention, only the side pull-type lay 6 which is not on the scanning side is driven and supplied with a suction force ensuring the static friction, whereas the non-driven side pull-type lay 6 is supplied with reduced suction force permitting sliding friction. Thus, the pull-type lay 6 at the driven side tautens the sheet leading edge before the side edge 16 of the sheet 11 is pulled towards the sensor 12. In this case, too, the edge 16 of the sheet 11 reaches precisely the desired lateral position 19 thereof.

The foregoing is a description corresponding in substance to German Application P 33 11 197.9, dated Mar. 26, 1983, the International priority of which is being claimed for the instant application, and which is hereby made part of this application. Any material discrepancies between the foregoing specification and the aforementioned corresponding German application are to be resolved in favor of the latter.

I claim:

1. Apparatus for in-register feeding a sheet into a sheet-processing machine by conveying the sheet in a given feed direction over a feed table, comprising front lays engageable by a leading edge of the sheet for aligning the leading edge of the sheet, a pair of side pull-type lays located in the feed table respectively on mutually opposite operator and drive sides of the feed table at a slight spacing from said front lays, both said side lays being movable in the plane of the feed table transversely to the given feed direction of the sheet, means for driving at least one of said side lays, positioning means having at least one sensor for controlling a displacement stroke of the driven side lay, air control means connected to a vacuum generator and to both of said side lays for controlling suction air flow to said side lays, at least one of said side lays having means for applying suction to the sheet until static friction is assured preparatory to aligning a respective lateral edge of the sheet, both of said side pull-type lays being driven so as to cover different placement strokes.

2. Apparatus according to claim 1 wherein one of said side pull-type lays is disposed at the scanning side of the feed table closer to said sensor than the other side lay, said air control means being actuatable for supplying reduced suction force to said one side lay so that the sheet is slidable on a suction surface of said one side lay.

3. Apparatus according to claim 1 wherein said other side pull-type lay is controllable by said positioning means for performing a greater displacement stroke than that of said one side lay, and air control means is actuatable for supplying reduced suction force to said other side lay so as to apply a sliding friction to the sheet.

4. Apparatus for in-register feeding a sheet into a sheet-processing machine by conveying the sheet in a given feed direction over a feed table, comprising front lays engageable by a leading edge of the sheet for aligning the leading edge of the sheet, a driven side pull-type lay located at a side of the feed table other than a scanning side thereof, a non-driven side pull-type lay located at a side of the feed table opposite said driven side lay, said driven side lay being movable in the plane of the feed table transversely to the given feed direction of the sheet, air control means connected intermediate to a vacuum generator and both of said side lays for controlling suction air flow to both said side lays, said air control means being actuatable for supplying said driven side lay with suction air assuring relatively high static friction and for supplying said non-driven side lay with suction air assuring relatively low static friction whereby the sheet is able to slide on a suction surface of said non-driven side lay.

5. Apparatus according to claim 4, wherein said driven said pull-type lay is located at a slight spacing from said front lays, and driving means is provided for moving said driven side lay in the plane of the feed table transversely to the given feed direction of the sheet, both said side lay and said driving means being adjustable transversely to the given sheet feed direction for accommodating a paper format being processed.

6. Apparatus for in-register feeding a sheet into a sheet-processing machine by conveying the sheet in a given feed direction over a feed table, comprising front lays engageable by a leading edge of the sheet for aligning the leading edge of the sheet, a first driven side pull-type lay located at a side of the feed table other than a scanning side thereof, a second driven side pull-type lay located at a side of the feed table opposite said first driven side lay, at least said first driven side lay being movable in the plane of the feed table transversely to the given feed direction of the sheet, air control means connected intermediate to a vacuum generator and said first and second side lay for controlling suction air flow to said side lays, said air control means being actuatable for supplying said first driven side lay with suction air assuring relatively high static friction and for supplying said second driven side lay with suction air assuring relatively low static friction whereby the sheet is able to slide on a suction surface of said second driven side lay.

7. Apparatus according to claim 1, wherein said driven side pull-type lays are located at a slight spacing from said front lays, and driving means for moving said driven side lays in the plane of the feed table transversely to the given feed direction of the sheet, both said side lays and said driving means being adjustable transversely to the given sheet feed direction for accommodating a paper format being processed.

* * * * *